United States Patent [19]

Harvey

[11] Patent Number: 4,712,074

[45] Date of Patent: Dec. 8, 1987

[54] VACUUM CHAMBER FOR CONTAINING PARTICLE BEAMS

[75] Inventor: Alexander Harvey, Los Alamos, N. Mex.

[73] Assignee: The United States of America as represented by the Department of Energy, Washington, D.C.

[21] Appl. No.: 801,881

[22] Filed: Nov. 26, 1985

[51] Int. Cl.[4] ..... H05H 1/10; H05H 13/04; H01J 5/02

[52] U.S. Cl. ..... 328/233; 328/235; 313/317

[58] Field of Search ..... 328/235, 233; 313/317

[56] References Cited

U.S. PATENT DOCUMENTS

| | | | |
|---|---|---|---|
| 2,553,312 | 5/1951 | Gurewitsch | 328/235 |
| 3,663,241 | 5/1972 | Short | 252/513 X |
| 3,673,117 | 6/1972 | Schroeder et al. | 252/513 X |
| 3,808,576 | 4/1974 | Castonguay et al. | 252/513 X |

OTHER PUBLICATIONS

"A Proposal to Extend the Intensity Frotier of Nuclear and Particle Physics to 45 GeV (LAMPF II)," Los Alamos National Laboratory report LA-UR-84-3982 (Dec. 1984).

Salvatore Giordano, "A Low Coupling Impedance Double Helix Structure for Use in a Ferrite Kicker Magnet", IEEE Trans. Nucl. Sci., NS-30, No. 4, 3496-3498 (Aug. 1983).

"SNS Radio Frequency Shields", Bulletin of the Rutherford Appleton Laboratory 12 (Aug. 1982).

P. B. Wilson et al., "Comparison of Measured and Computed Loss to Parasitic Modes in Cylindrical Cavities with Beam Ports", Contributed to the 1977 Particle Accelerator Conference, Chicago, Illinois, Mar. 16-18, 1977 (SLAC-PUB-1908 PEP-240, Mar. 1977).

A. Piwinski, "Penetration of the Field of a Bunched Beam Through a Ceramic Vacuum Chamber with Metallic Coating", IEEE Trans. Nucl. Sci. NS-24, No. 3, 1364-1366 (Jun. 1977).

J. Peters, "Bench Measurements of the Energy Loss of a Stored Beam to Vacuum Components", IEEE Trans. Nucl. Sci. NS-24 No. 3, 1446-1448 (Jun. 1977).

J. R. J. Bennett et al., "Glass Jointed Alumina Vacuum Chambers", IEEE Trans. Nucl. Sci. NS-28 No. 3, 3336-3338 (Jun. 1981).

E. B. Tilles et al., "Long Ceramic Beam Tubes for Accelerator Magnets", IEEE Trans. Nucl. Sci. NS-30 No. 4, 2847-2849 (Aug. 1983).

David Neuffer, "Vacuum Requirements for LAMPF II", Los Alamos National Laboratory report LA-1022-4-MS (Aug. 1984).

*Primary Examiner*—Palmer C. DeMeo

*Attorney, Agent, or Firm*—Joseph M. Hageman; Ray G. Wilson; Judson R. Hightower

[57] ABSTRACT

A vacuum chamber for containing a charged particle beam in a rapidly changing magnetic environment comprises a ceramic pipe with conducting strips oriented along the longitudinal axis of the pipe and with circumferential conducting bands oriented perpendicular to the longitudinal axis but joined with a single longitudinal electrical connection. When both strips and bands are on the outside of the ceramic pipe, insulated from each other, a high-resistance conductive layer, such as nickel can be coated on the inside of the pipe.

17 Claims, 3 Drawing Figures

VACUUM CHAMBER FOR CONTAINING PARTICLE BEAMS

BACKGROUND OF THE INVENTION

The present invention relates generally to a composite vacuum chamber for use in containing a particle beam and more particularly to a vacuum chamber for such use in a rapidly changing magnetic environment. This invention is the result of a contract with the Department of Energy (Contract No. W-7405-ENG-36).

Particle beams produced in accelerators generally have to travel in a vacuum. This means that the travel path for the particle beam must be within an enclosure, such as a vacuum chamber. The vacuum chamber, of course, must be strong enough to withstand the inward press of the atmosphere. Metal pipes are strong enough to withstand atmospheric pressure. However, metal pipes introduce magnetic field perturbations due to their electrical conductivity. Furthermore, the rapidly changing magnetic environment induces eddy-currents within the metal of the pipe. Given enough strength and repetitive change in the magnetic field, these eddy-currents can heat the pipes sufficiently to deform or completely destroy the integrity of the seal against the atmosphere, in addition to drawing power from the magnetic field. On the other hand, the vacuum chamber must have conductivity in order to stabilize the beam. For this, a metal pipe is more than adequate.

Ceramic pipes have also been known as being strong enough to preserve a vacuum within and not be deformed by the pressure of the atmosphere. However, the ceramic pipe is an insulator and, hence, is unable to serve as a conductive pathway for rf currents. Thus, when the particle beam travels within a ceramic vacuum chamber, image currents are not able to travel along the chamber walls. This will cause instabilities in the particle beam. However, because the ceramic chamber is basically nonconductive, the rapidly changing magnetic environment will not induce eddy-currents therein.

In the article "A Low Coupling Impedance Double Helix Structure for Use in a Ferrite Kicker Magnet," written by Salvatore Giordano that appeared in IEEE Transactions on Nuclear Science, Vol. NS-30, No. 4, August 1983, pp. 3496–3498, a double helix wound wire structure was proposed to overcome beam coupling impedance inside an ejection kicker magnet between the beam and the material of the magnet. The double helix wound wire, however, still allowed the external magnetic fields of the kicker magnet to penetrate itself. However, a double helix wound wire structure cannot be used with higher intensity beams, i.e., above 1 $\mu$A for beam current, because the transverse impedance of the structure is not low enough. A radio-frequency shield for use in the fast cycling magnets of the SNS synchrotron, as described in the Bulletin of the Rutherford Appleton Laboratory (in Oxon, England) No. 12, Aug. 23, 1982, consisted of a cage framework of wires running parallel to the direction of beam travel with nonconducting frames for maintaining wire separation at regular intervals along the beam travel axis. While this framework provided good longitudinal conducting pathways for carrying image currents, it did not have any transverse conductivity, and was complex and expensive to produce.

Overall a need still existed for a vacuum chamber which combined the characteristics of a sufficiently low rf impedance to allow the carrying of high-frequency image currents to provide beam stabilization and yet at the same time a high enough low-frequency impedance to minimize eddy-current losses and minimize distortion of the applied magnetic field. If the vacuum chamber for guiding intense particle beams does not meet both of these requirements, beam instabilities result. These beam instabilities would eventually cause the beam to be lost. Furthermore, it is necessary that the inside of an insulating vacuum chamber have some electrical conductivity to prevent the build-up of static charge.

SUMMARY OF THE INVENTION

The object of this invention is to provide a vacuum chamber for use in containing a particle beam in a rapidly changing magnetic environment which is strong enough to withstand deformation or collapse due to atmospheric pressure.

A further object of this invention is to provide a vacuum chamber with sufficiently low high-frequency impedance to allow rf image currents to travel down the walls.

Yet another object of the present invention is to provide a vacuum chamber for use in a rapidly changing magnetic environment which has sufficiently high low-frequency impedance to prevent the build-up of large eddy-currents that may melt or otherwise deform the structure as well as destabilize the beam and its travel path.

The final object of the present invention is to provide a vacuum chamber for use in guiding a particle beam which prevents the build-up of static charge and other factors which lead to other beam instabilities.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the apparatus of this invention may comprise: a vacuum chamber for containing a charged particle beam in a rapidly changing magnetic environment comprising: a ceramic pipe; conducting strips oriented substantially parallel to the longitudinal axis of said pipe; and circumferential conducting bands insulatively separated from said conducting strips, oriented in a direction perpendicular to the longitudinal axis of said pipe, and joined together by a single longitudinal electrical connection.

The present invention may also comprise, in accordance with its objects and purposes, a vacuum chamber for containing a charged particle beam in a rapidly changing magnetic environment comprising: a ceramic pipe; silver conducting strips oriented substantially parallel to the longitudinal axis of the pipe; a layer of glass dielectric surrounding the conductive strips; silver bands circumferentially enclosing the first glass dielectric layer, oriented in a direction perpendicular to the longitudinal axis of the pipe and joined together by a single longitudinal electrical connection; and a final outside glass dielectric layer.

An advantage of the present invention is the provision of a vacuum chamber capable of carrying rf image currents to help provide beam stabilization.

Another advantage of the present invention is the provision of a vacuum chamber for use in a rapidly changing magnetic environment which does not generate sufficient eddy-currents to harm the integrity of the ceramic pipe, or the quality of the magnetic field.

Yet another advantage of the present invention is to minimize beam instabilities induced during the transit of the vacuum chamber by the beam.

Another advantage of the present invention is that when the strips and bands are separated by a dielectric layer, this structure acts as a built-in capacitor, thus eliminating the need for separate discrete capacitors to be attached to the strips at one end of the vacuum chamber.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE PREFERRED EMBODIMENTS

Figure 1:
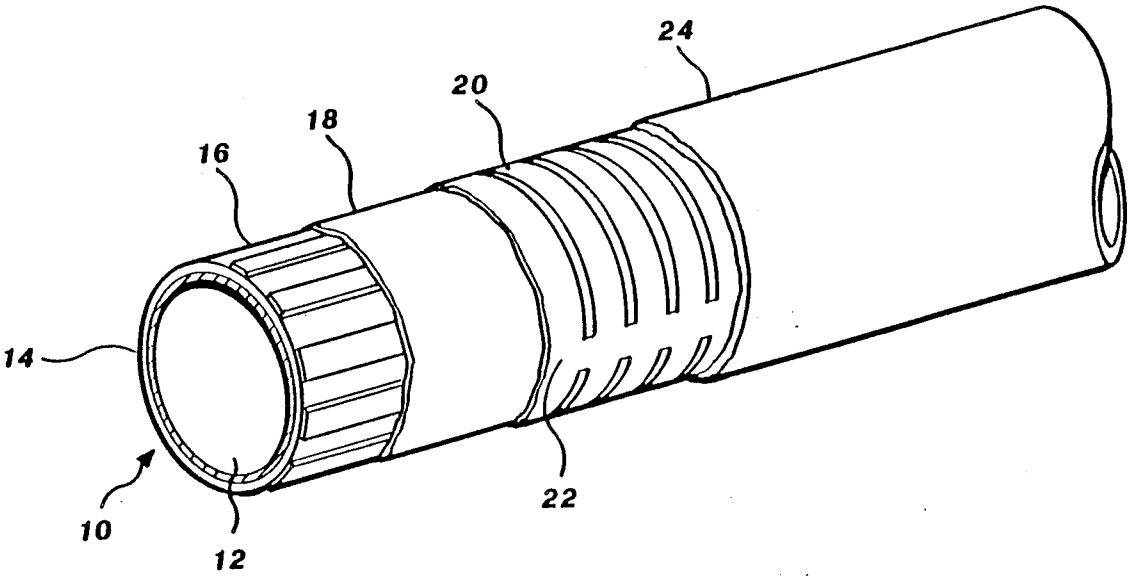
FIG. 1 is a progressively cutback cross-sectional perspective of a vacuum chamber.

The basic mechanical structure for the vacuum chamber is fabricated from alumina of 94 to 99% purity. This material proves to be a strong radiation-resistant insulator with the sufficient integrity and lack of porosity needed to maintain a good vacuum inside the chamber. One fabrication method is by isostatic pressing and firing, giving dimensional tolerances of around 2%. Even better tolerances can be achieved by grinding the fired ceramic chamber. The ceramic pipe will be made in sections, generally about 1 m long. the sections will be assembled using glass sealing joints. The cross section need not be circular, but may be square, rectangular, oval, etc. as required.

If the first conducting strips are to be placed on the outside of the vacuum chamber, the inside can be coated with either a pure nickel or a nickel phosphide deposited by chemical vapor deposition techniques well-known in the art. A wide variety of other resistive coatings can be sprayed on using organometallics, or applied as described in an article "Long Ceramic Beam Tubes for Accelerator Magnets," written by E. B. Tilles, et al. that appeared in IEEE Transactions on Nuclear Science, Vol. NS-30, No. 4, August 1983, pp. 2847–2849. The conducting strips, both in the first and second set, can be made from any good conductor. Preferably, the strips are made with silver, most preferably high-purity silver. The conducting strips can be applied using a variety of hybrid thick-film circuit fabrication techniques. Because of the three-dimensional nature of the pipe, spray or brush application works best. These techniques are well-known in the art of circuitry fabrication, especially for circuit boards. After application of the first conducting strips, when the conducting strips are on the outside of the ceramic pipe, the pipe is heat treated. The inks necessary to apply the conducting strips must be selected so that they will withstand an extended period of high temperature. In general, such inks will not contain palladium.

When the strips are made with Englehard A-3059 silver (available from Englehard Minerals & Chemical Corp., East Newark, N.J. 07029) these conducting strips and the pipe are fired at 930° C. in air for at least 10 minutes. After the pipe has cooled down to room temperature again, a glass dielectric layer is applied by spraying or brushing. When the glass dielectric layer is composed of Englehard A-2835 glass, the layer is fired at 850° C. in air for at least 10 minutes. A second such coating to thicken this layer and reduce the chance of a pinhole failure can be applied by repeating this step. The silver conducting bands are applied in a similar manner to the glass dielectric layer as the silver conducting strips were to the ceramic pipe. If the same silver (Englehard A-3059) is used, the bands are fixed by firing at 830° C. in air for at least 10 minutes. Next, the outside protective dielectric layer is applied in the same way as the first layer or two of dielectric glass. if the same glass mixture (Englehard A-2835) is used, the layer is fired at 800° C. in air for 10 minutes. Finally, the high-resistance conductive layer coating is applied to the inside of the ceramic pipe. If nickel is used to form the inside layer, the pipe is filled with nickel carbonyl and heated to 200° C. The vacuum chamber can then be fired at temperatures up to 650° C. for 3–4 days to drive out all the volatile components from the inside walls of the ceramic pipe. This heat treatment prevents contamination of the vacuum by outgassing from the inside walls of the pipe.

When the first conducting strips are applied to the interior of the ceramic pipe, this requires another technique. This means that the conducting strips are painted on by a application mechanism that travels through the pipe. One possibility is to use an internal mask to provide the desired conductor pattern.

The use for a vacuum chamber fabricated as above would primarily be in particle accelerators, for example, synchrotrons such as the proposed LAMPF-II (Los Alamos Meson Physics Facility-II at Los Alamos, N. Mex.).

Referring now to FIG. 1, the progressively cutback cross-sectional perspective of a vacuum chamber, it can be seen that the inside of the vacuum chamber 10 is coated with a layer 12 of nickel. This nickel layer 12 can be from 300 to 3,000 Å thick. Preferably it is from 1,000 to 2,000 Å thick, and most preferably is on average 1,500 Å thick. A ceramic pipe 14 is fabricated in a shape to match the expected particle beam cross section. The wall thickness of this pipe is designed to withstand the stresses caused by the outside atmospheric pressure. The first conducting strips 16 are applied to the outside of the ceramic pipe 14. These conducting strips 16 are oriented parallel to the longitudinal axis of the beam pipe. Typically, the strips 16 are 1 cm wide and 10 to 50 μm thick. Typically the neighboring edges of the conducting strips 16 are separated by 1 cm. The next layer is a glass dielectric 18 which is 40–50 μm thick. The third layer is composed of circumferential conducting bands 20 which are 1 cm wide by 10–50 μm thick. The neighboring edges are separated by 0.05 cm. A single longitudinal electrical connection 22 joins together the circumferential conducting bands 20. The fourth layer 24 is a layer of glass dielectric material, similar to 18, 50–100 μm thick.

Figure 2:
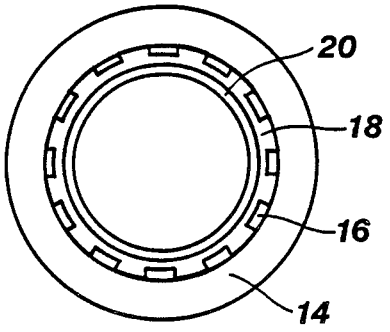
FIG. 2 is a cross-sectional perspective of a vacuum chamber with a different arrangement of strips and bands.

Referring now to FIG. 2, a cross section of a vacuum chamber, another arrangement of the conducting strips 16 and conducting bands 20 is displayed. The conducting strips 16 are shown attached to the inside wall of the ceramic pipe 14. A glass dielectric layer 18 is used to separate the conducting strips 16 from the conducting bands 20.

Figure 3:
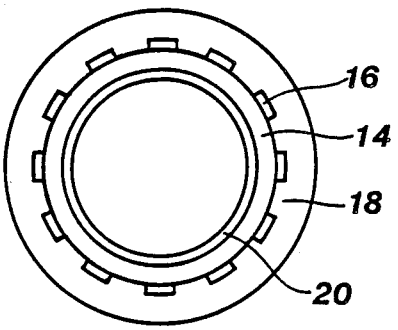
FIG. 3 is a cross section of a vacuum chamber with a different arrangement of strips and bands.

Referring now to FIG. 3, a cross section of a vacuum chamber, yet another arrangement of the conducting strips 16 and the conducting bands 20 is displayed. In this arrangement, the conducting bands 20 are disposed within the ceramic pipe 14. The conducting strips 16 are disposed on the outside of the ceramic pipe 14. Covering the conducting strips 16 and the outside of the ceramic pipe which is not covered by the conducting strips 16 is a glass dielectric layer 18.

Although the above dimensions for the various layers and conducting strips and bands are tailored for use in a particular proposed machine (LAMPF-II), these dimensions should not be understood as being useful in synchrotrons of all dimensions and powers. The high-resistance conductive layer on the inside of the ceramic pipe is intended to prevent charge build-up by bleeding away the charge induced by the beam on the inside wall. The amount of charge induced will depend upon the characteristics of the beam and the ability to bleed away charge will depend upon the choice of material (its conductivity) as well as the layer's thickness. However, the inside layer must still be thin enough to have a negligible effect on the fields produced by magnets surrounding the vacuum chambers.

In a similar manner, the dimensions of the conducting strips and bands can be tailored to bring about desired electrical conditions that the charged particle beam should experience traveling through the vacuum chambers. For instance, the longitudinal rf impedance as well as the low frequency eddy-current losses due to the varying magnetic fields can be altered by changing the dimensions of the applied conducting strips. Also, the transverse rf impedance can be varied by changing the dimensions of the circumferential conducting bands. Additionally, the coupling between induced rf currents in the longitudinal conducting strips and the circumferential conducting bands can be altered by varying the thickness of the insulating dielectric layer between the strips and bands, and the separation between the strips. Overall, because some of the desired electrical conditions dictate contradictory requirements for the dimensions of the conducting bands and strips, the vacuum chamber designer can balance these requirements to produce the best set of overall electrical characteristics given the overall parameters imposed by the design of the accelerator.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments an with various modifications as are suited to the particular use contemplated. It is intended that the scope of the invention be defined by the claims appended hereto.

What is claimed is:

1. A vacuum chamber for containing and stabilizing a charged particle beam in a rapidly changing magnetic environment comprising:

a. a ceramic pipe;

b. conducting strips oriented substantially parallel to and coaxial with the longitudinal axis of said pipe; and c. circumferential conducting bands insulatively separated from said conducting strips, oriented in a direction perpendicular to the longitudinal axis of said pipe, and joined together by a single longitudinal electrical connection.

2. The vacuum chamber of claim 1 wherein said conducting strips are inside said ceramic pipe.

3. The vacuum chamber of claim 2 wherein said circumferential conducting bands are also inside said ceramic pipe.

4. The vacuum chamber of claim 1 wherein said conducting strips are attached to the outside walls of said ceramic pipe.

5. The vacuum chamber of claim 4 wherein circumferential conducting bands are inside said ceramic pipe.

6. The vacuum chamber of claim 4 wherein said circumferential conducting bands are outside of said ceramic pipe and insulatively separated from said conducting strips by a dielectric layer.

7. The vacuum chamber of claim 6 wherein said dielectric layer consists of glass.

8. The vacuum chamber of claim 6 wherein the inside walls of said ceramic pipe are coated with a high-resistance conductive layer.

9. The vacuum chamber of claim 8 wherein said high-resistance layer comprises nickel.

10. The vacuum chamber of claim 8 wherein said high-resistance layer comprises nickel phosphide.

11. The vacuum chamber of claim 6 wherein said circumferential conducting bands are outside of said conducting strips and said insulating dielectric layer and further are covered by a dielectric layer.

12. The vacuum chamber of claim 1 wherein said conducting strips and said circumferential conducting bands comprise silver.

13. The vacuum chamber of claim 1 wherein said cermaic pipe consists of alumina.

14. The vacuum chamber of claim 1 wherein said conducting strips are 1 cm wide, 50 $\mu$m thick, and from 0.5 to 1.5 cm from each other.

15. The vacuum chamber of claim 1 wherein circumferential conducting bands are 1 cm wide, 50 $\mu$m thick, and from 0.01 to 0.5 cm from each other.

16. The vacuum chamber of claim 1 wherein said ceramic pipe has been heat-treated sufficiently to prevent substantial contamination of the vacuum by outgassing from the inside walls of said pipe.

17. The vacuum chamber of claim 1 wherein said conducting strips are disposed in longitudinal contact with said ceramic pipe.

* * * * *